US005893634A

United States Patent [19]

Wang

[11] Patent Number: 5,893,634

[45] Date of Patent: Apr. 13, 1999

[54] DECORATIVE LIGHT BULB STAND WITH CLIPPING STRUCTURE

[76] Inventor: Jessica Wang, 4F-3, No. 77, Sec. 2, Tun Hwa South Rd., Taipei, Taiwan

[21] Appl. No.: 08/975,948

[22] Filed: Nov. 21, 1997

[51] Int. Cl.[6] ..... F21V 19/00

[52] U.S. Cl. ..... 362/249; 362/396

[58] Field of Search ..... 362/249, 252, 362/396, 806

[56] References Cited

U.S. PATENT DOCUMENTS

| | | | |
|---|---|---|---|
| 1,726,585 | 9/1929 | Propp | 362/252 |
| 4,769,749 | 9/1988 | Felski | 362/249 |
| 5,329,434 | 7/1994 | Hong | 362/249 |
| 5,664,877 | 9/1997 | Wu | 362/252 |
| 5,664,879 | 9/1997 | Lai | 362/249 |
| 5,669,709 | 9/1997 | Adams | 362/249 |

*Primary Examiner*—Alan Cariaso

*Attorney, Agent, or Firm*—Pro-Techtor International Services

[57] ABSTRACT

A light bulb stand includes a stand body for connecting a light bulb to electrical wires and a clipping structure attached to the stand body. The clipping structure includes a first portion and a second portion mounted to the stand body to be opposite to each other and the first portion and the second portion are complementary in configuration to each other so that the first portion of a first light bulb stand is engageable with the second portion of a second light bulb stand to secure the bulb stands together. Further, the clipping structure may be separate from the bulb stand to connect two bulb stands together. The separate clipping structure may includes two C-shaped members that may be connected to each other in any suitable ways to define clipping structures of different configurations.

1 Claim, 6 Drawing Sheets

DECORATIVE LIGHT BULB STAND WITH CLIPPING STRUCTURE

FIELD OF THE INVENTION

The present invention relates generally to a light string and in particular to a light bulb stand which is used to form a light string by connecting a lot of the bulb stands on electrical wires and more particular to a clipping structure which releasably holds the bulb stands and/or the wires together in a desired pattern to provide a more appealing decorative light.

BACKGROUND OF THE INVENTION

Decorative light strings have been widely used in all kinds of celebration and festival. The decorative light strings comprise electrical wires of a substantial length to which a plurality of the lamp bulbs are connected by means of bulb stands fixed on the wires, preferably in spaced manner. FIG. 1 of the attached drawings shows an example of the decorative light string which comprises electrical wires 10 on which bulb stands 12 are fixed to each receive and hold therein a bulb 14 that is in electrical connection with the wires 10. A plug 16 and a socket 18 may be provided to the wires 10 for connection with an external power source (not shown) and to provide an electrical connection to another light string. The light string may be attached to any desired article or object, such as a tree, a window or a curtain. The arrangement of the light string on an article may be in any arbitrary pattern by fixing the wires and the bulb stands to the article and to themselves.

An example of the arrangement of the light string is shown in FIG. 2. The decorative light string in this example includes a number of series light strings forming a light curtain. The light curtain includes an electric plug 22, an electric receptacle 24, a first electric power wire L1, a second electric power wire L2, and a number of connecting wires 20. The light bulb stand 100 with clipping structure of the present invention may allow the two bulb stands 100 to be held together. In addition, the clipping structure of the bulb stand 100 may serves as a passage to allow the wires 20 extending therethrough and held therein. So, various arrangements may be formed.

The present invention is directed to a decorative light bulb stand with clipping structure to provide ready fixing of the bulb stands and the wires together so that generally consumers may arrange the light string in any desired manner and pattern and may re-arrange the light string readily.

SUMMARY OF THE INVENTION

Therefore, the principal object of the present invention is to provide a light bulb stand comprising a clipping structure mounted thereon to provide a ready-to-form engagement between bulb stands and/or portions of electrical wires.

In accordance with the present invention, a light bulb stand is provided, comprising a stand body for connecting a light bulb to electrical wires and a clipping structure attached to the stand body. The clipping structure comprises a first portion and a second portion mounted to the stand body to be opposite to each other and the first portion and the second portion are complementary in configuration to each other so that the first portion of a first light bulb stand is engageable with the second portion of a second light bulb stand to secure the bulb stands together.

Another object of the present invention is to provide a clipping structure for securing bulb stands and/or electrical wires together.

In accordance with another aspect of the present invention, there is provided a clipping structure, comprising two C-shaped members, each adapted to receive and hold a bulb stand or a portion of electrical wires therein. The C-shaped members may be connected to each other in different ways to define different configurations of the clipping structure. The C-shaped members may be connected in such a way to have the openings facing away from each other or assuming an S shape or a ω shape. Alternatively, the two C-shaped members may be provided with fastener means at two ends thereof for securing them together.

BRIEF DESCRIPTION OF THE DRAWINGS

The present invention will be described in further detail with reference to the accompanying drawings, wherein.

DETAILED DESCRIPTION OF THE PREFERRED EMBODIMENT

Figure 1:
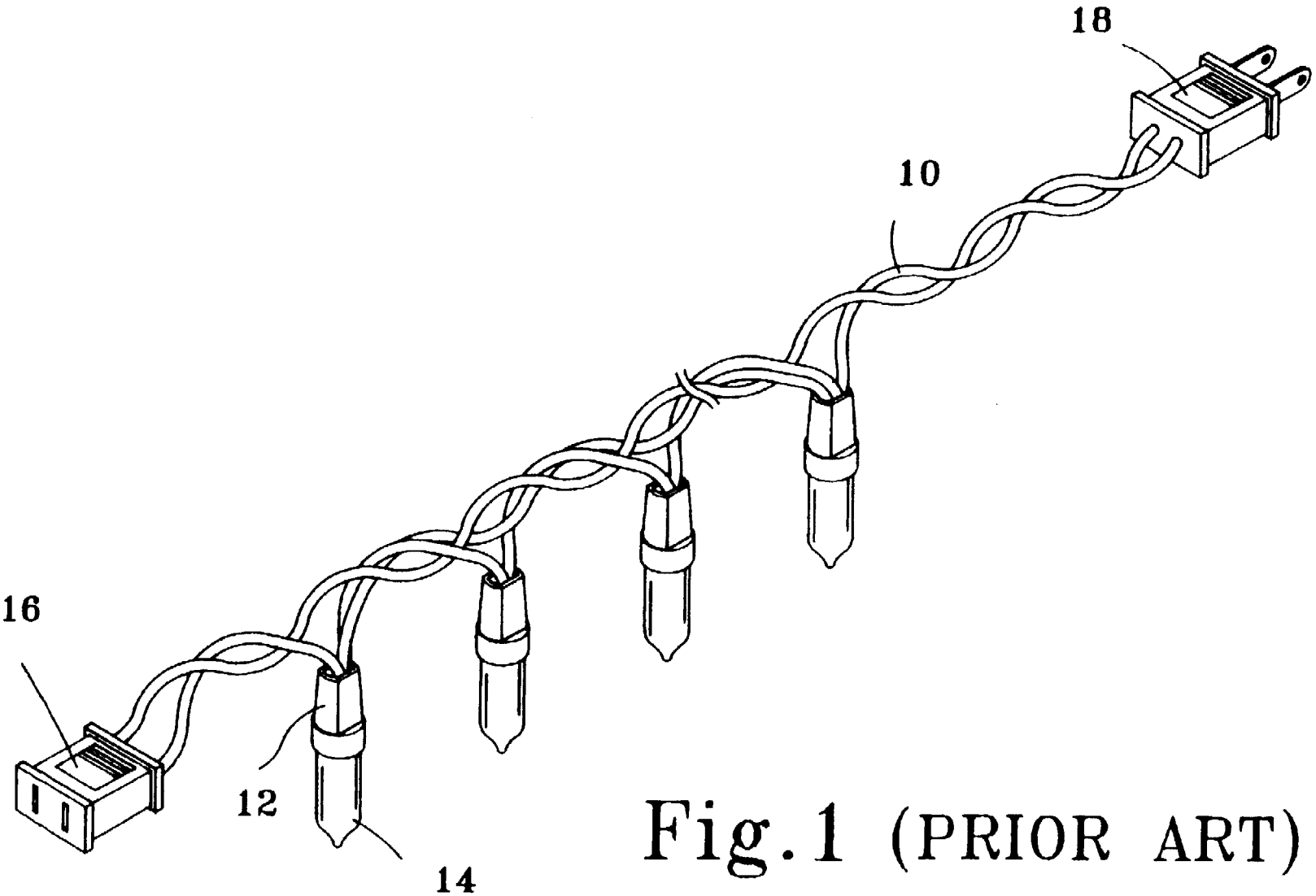
Fig. 1 (PRIOR ART)
FIG. 1 is a perspective view showing a decorative light bulb string which is known.
Figure 2:
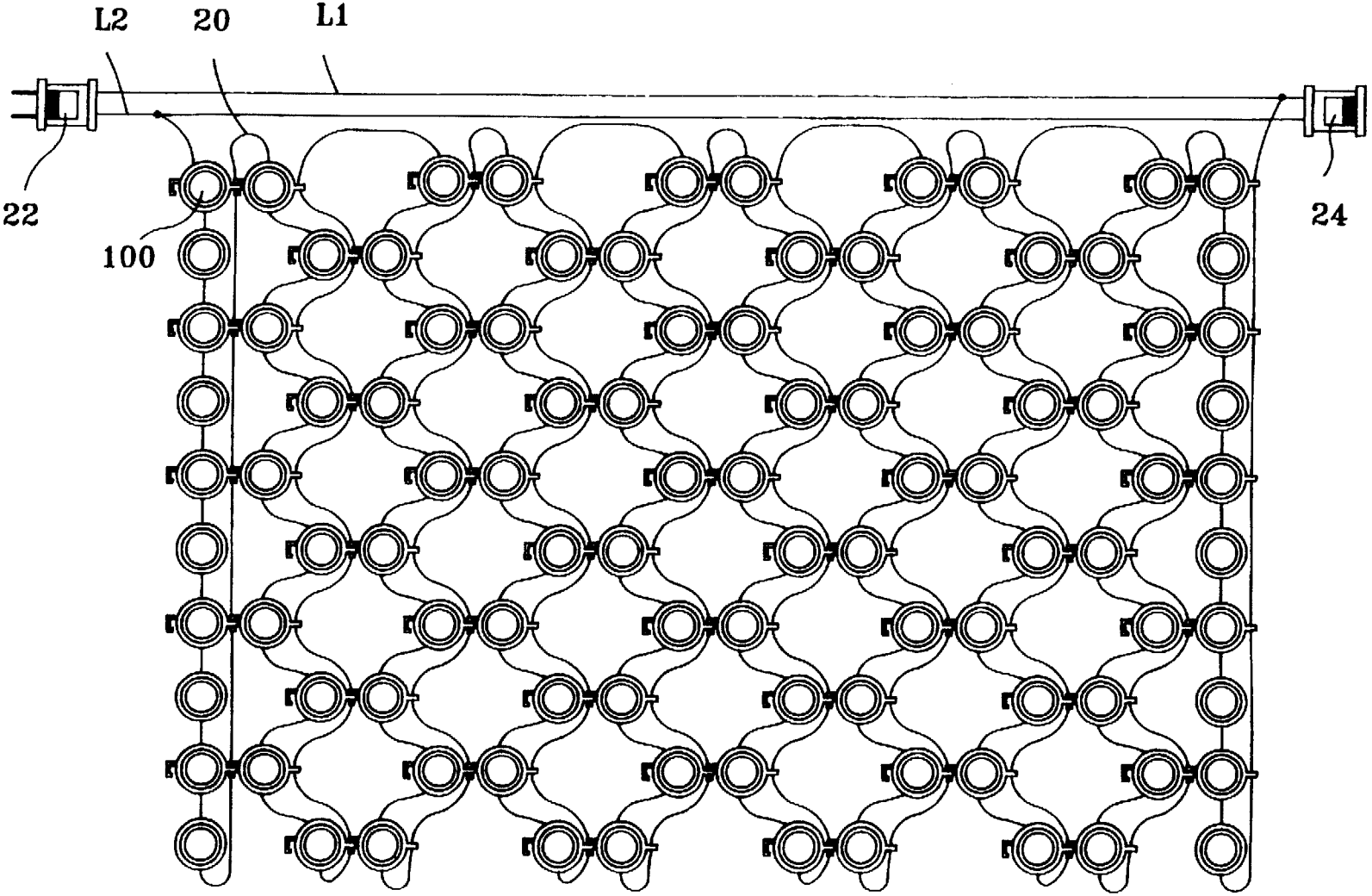
FIG. 2 is a plan view showing a decorative light bulb string pattern formed by using the clipping structure in accordance with the present invention.
Figure 3:
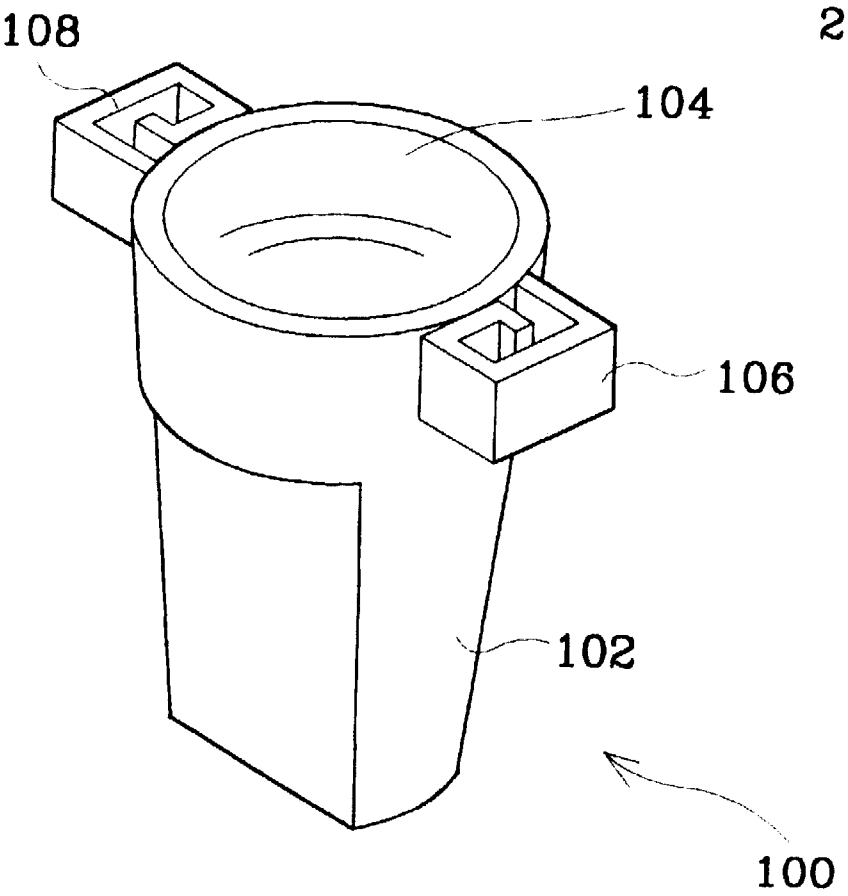
FIG. 3 is a perspective view showing a first embodiment of the present invention.

With reference to the drawings and in particular to FIG. 3, wherein a bulb stand with clipping structure constructed in accordance with a first embodiment, generally designated with reference numeral 100, is shown, the bulb stand 100 of the present invention comprises a stand body 102 having formed on one end thereof a cavity 104 for receiving therein a bulb (not shown). As is known to those skilled in the art, conductive tabs (not shown) are provided inside the cavity 104 for providing electrical connection with the bulb and the stand body 102 also comprises wire channels (not shown) extending through the stand body 102, preferably at an end of the stand body 102 opposite to the cavity 104, through which electrical wires 20 (see FIG. 2) extends to electrically connect to the conductive tabs for supply of electricity from for example an external power source to the bulb.

In accordance with the present invention, the bulb stand body 102 is provided with a clipping structure which comprises a first portion 106 and a second portion 108 attached to two opposite sides thereof. The first portion 106 is complementary in spatial configuration to the second portion 108 so as to allow the first portion 106 of a first bulb stand 100 to be releasably engageable with the second portion 108 of a second bulb stand 100. This allows two bulb stands 100 to be arbitrarily attached to each other to form a desired pattern. Also, at least one of the first and second portions 106 and 108 of the clipping structure is provided with means for receiving and holding therein the electrical wires 20 to which the bulb stands 100 are mounted. FIG. 2 shows an example of the arrangement of the bulb stands 100 and the electrical wires 20 by means of the clipping structure of the bulb stands 100. Also shown in FIG. 2 are a plug 22 and a socket 24 for providing electrical connection with other light bulb string or an external power source (both not shown).

In the first embodiment, the first portion 106 and the second portion 108 of the clipping structure of the bulb stand 100 are made identical, comprising a rectangular winding configuration, as shown, comprised of a number of straight segments of a predetermined thickness with a spacing having a width corresponding the thickness provided between the segments so as to complementary to each other and thus allowing the first portion 106 of the first bulb stand 100 to be fit into the spacing between the segments of the second portion 108 of the second bulb stand 100. This allows the two bulb stands 100 to be held together. Preferably, the first and the second portions 106 and 108 are made of an elastically deformable material for more securely holding the two bulb stands 100 together. The spacing of either the first portion 106 or the second portion 108 serves as a passage to allow the wires 20 extending therethrough and held therein.

Figure 4:
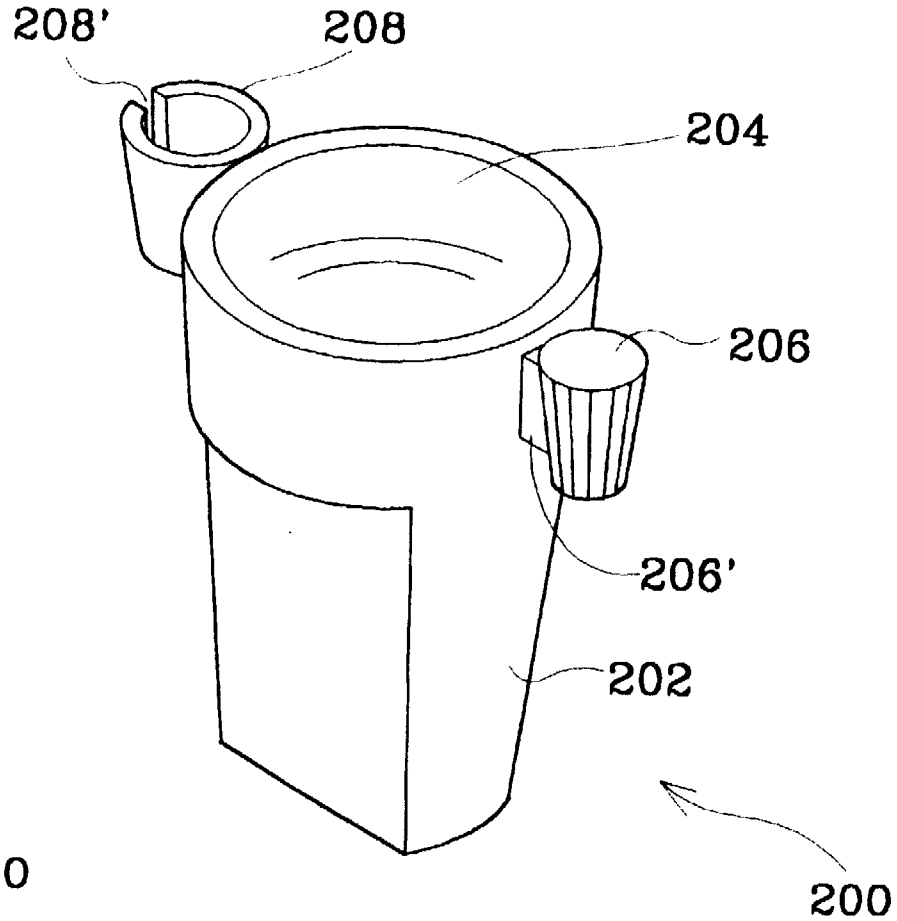
FIG. 4 is a perspective view showing a second embodiment of the present invention.

FIG. 4 shows a second embodiment of the bulb stand in accordance with the present invention, wherein the second embodiment bulb stand is designated at 200 comprising a bulb stand body 202 having a cavity 204 formed on one end for receiving therein a bulb (not shown). The stand body 202 also comprises un-illustrated conductive tabs to which wires (not shown) extending through channels (not shown) formed on the stand body 202 are connected for supply of electricity to the bulb received in the cavity 204 and in electrical engagement with the conductive tabs. The second embodiment bulb stand 200 also comprises a clipping structure which includes a first portion 206 in the form of a solid post which in the embodiment illustrated has a circular cross section (namely, the post being cylindrical) substantially parallel with the stand body 202 and connected thereto by means of a reduced section 206' and a second portion 208 in the form of a hollow member having a cross section complementary to the post 206 mounted to an opposite side of the stand body 202 with a side opening 208' sized to receive the reduced section 206' of the solid post 206 therein. Preferably, the first portion 206 and the second portion 208 are made elastically deformable so as to allow the first portion 206 of a first bulb stand 200 to be received and held in the second portion 208 of a second bulb stand 200 by means of elastic deformation. This provides a ready and easy engagement between two bulb stands 200. The hollow configuration of the second portion 208 also allows the electrical wires to be received and held therein.

Figure 5:
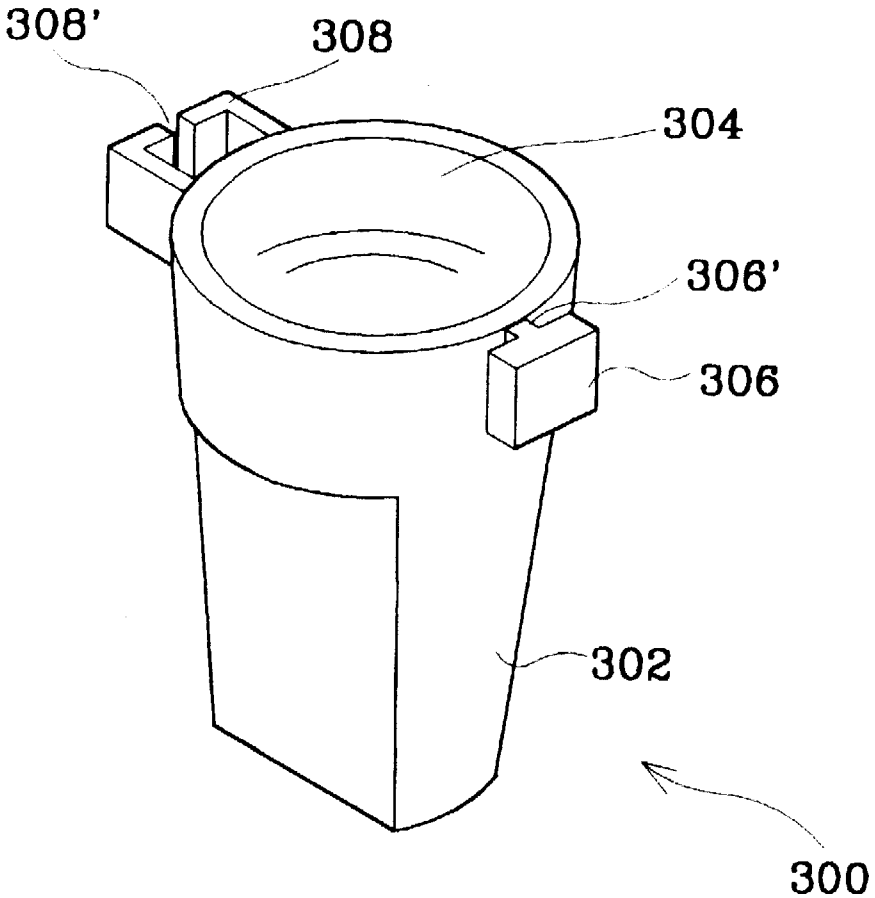
FIG. 5 is a perspective view showing a third embodiment of the present invention.

FIG. 5 shows a third embodiment of the bulb stand in accordance with the present invention, wherein the third embodiment bulb stand is designated at 300 comprising a bulb stand body 302 having a cavity 304 formed on one end for receiving therein a bulb (not shown). The stand body 302 also comprises un-illustrated conductive tabs to which wires (not shown) extending through channels (not shown) formed on the stand body 302 are connected for supply of electricity to the bulb received in the cavity 304 and in electrical engagement with the conductive tabs. The third embodiment bulb stand 300 also comprises a clipping structure which includes a first portion 306 in the form of a solid post which in the embodiment illustrated has a rectangular or square cross section substantially parallel with the stand body 302 and connected thereto by means of a reduced section 306' and a second portion 308 in the form of a hollow member having a cross section complementary to the post 306 mounted to an opposite side of the stand body 302 with a side opening 308' sized to receive the reduced section 306' of the solid post 306 therein. Preferably the first portion 306 and the second portion 308 are made elastically deformable so as to allow the first portion 306 of a first bulb stand 300 to be received and held in the second portion 308 of a second bulb stand 300 by means of elastic deformation. This provides a ready and easy engagement between two bulb stands 300. The hollow configuration of the second portion 308 also allows the electrical wires to be received and held therein.

Figure 6:
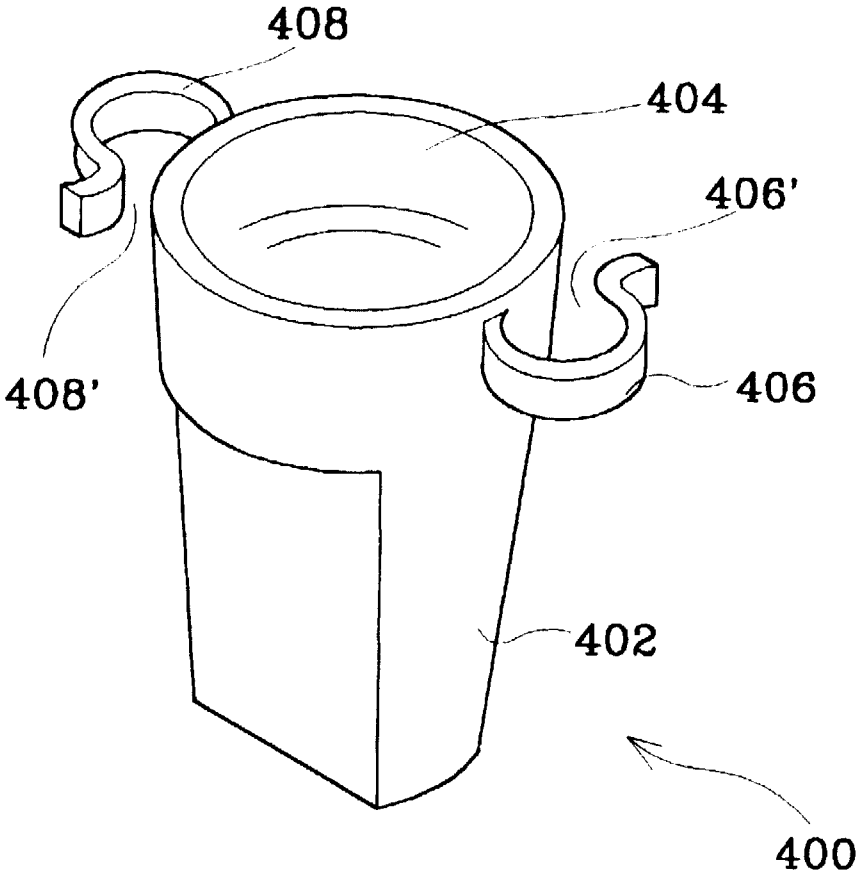
FIG. 6 is a perspective view showing a fourth embodiment of the present invention.

FIG. 6 shows a fourth embodiment of the bulb stand in accordance with the present invention, wherein the fourth embodiment bulb stand is designated at 400 comprising a bulb stand body 402 having a cavity 404 formed on one end for receiving therein a bulb (not shown). The stand body 402 also comprises un-illustrated conductive tabs to which wires (not shown) extending through channels (not shown) formed on the stand body 402 are connected for supply of electricity to the bulb received in the cavity 404 and in electrical engagement with the conductive tabs. The fourth embodiment bull) stand 400 also comprises a clipping structure which includes a first portion 406 and a second portion 408 mounted to two opposite sides of the stand body 402. The first portion 406 and the second portion 408 of the clipping structure in accordance with the fourth embodiment are identical, comprising an S-shaped configuration having two bends and two ends with one end fixed to the stand body 402 in such a way to have one of the bends facing the stand body 402 to form a spacing between the bend and the stand body 402 and another bend facing away from to define a gap 406' or 408' with the stand body 402 which is smaller than the spacing so as to allow the S-shaped first portion 406 of a first bulb stand 400 to be received and held within the S-shaped second portion 408 of a second bulb stand 400. Preferably, the first and second portions 406 and 408 are made elastically deformable so as to allow the first portion 406 to be more securely held in the second portion 408 by means of elastic deformation. This provides a ready and easy engagement between two bulb stands 400. The spacing of either the first portion 406 or the second portion 408 serves as a passage to allow the wires extending therethrough and held therein.

The clipping structure in accordance with the present invention may be integrally formed with the stand body, as shown in the first, second, third and fourth embodiment discussed with reference to FIGS. 3–6. However, the clipping structure may also be made as a separate member from the stand body and this will be discussed hereinafter with reference to FIGS. 7–10.

Figure 7:
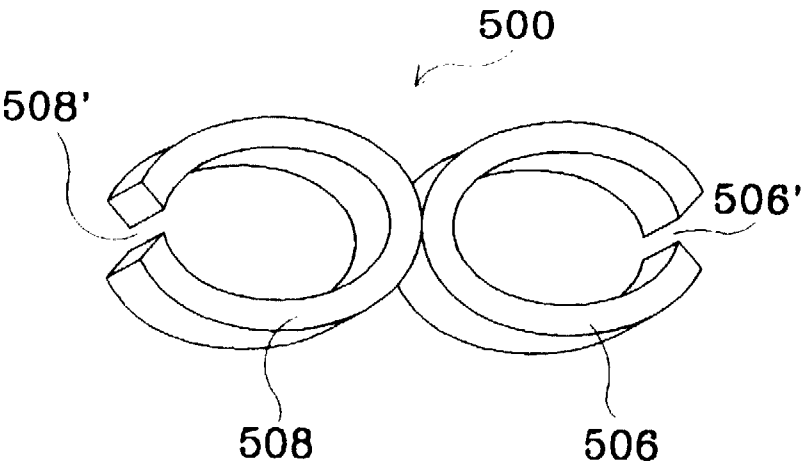
FIG. 7 is a perspective view showing a fifth embodiment of the present invention.

FIG. 7 shows a bulb stand clipping structure in accordance with a fifth embodiment of the present invention, which is designated with reference numeral 500, comprising a first portion 506 and a second portion 508, both being in the form of a C shape having a side opening 506' or 508' and connected in back-to-back manner to have the side openings 506' and 508' facing away from each other. The C shapes have a size sufficient to receive therein bulb stands (not shown) so as to fix two bulb stands together, or alternatively receiving a portion of electrical wires (not shown) therein so as to secure the electrical wires to a bulb stand or to secure two portions of the electrical wires together. The side openings 506' and 508' provide means for facilitating mounting a bulb stand to the C shapes 506 and 508 and also providing elastic deformation to more securely hold the bulb stand or the electrical wires therein.

Figure 8:
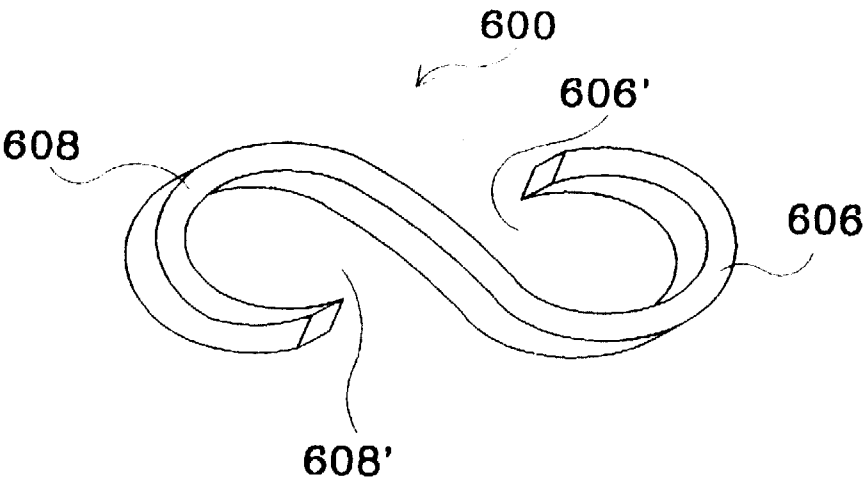
FIG. 8 is a perspective view showing a sixth embodiment of the present invention.

FIG. 8 shows a bulb stand clipping structure in accordance with a sixth embodiment of the present invention, which is designated with reference numeral 600, comprising a first portion 606 and a second portion 608, both being in the form of a C shape having a side opening 606' or 608' and connected in such a way to define an S shape. The C-shaped portions 606 and 608 have a size sufficient to receive therein bulb stands (not shown) so as to fix two bulb stands together, or alternatively receiving a portion of electrical wires (not shown) therein so as to secure the electrical wires to a bull) stand or to secure two portions of the electrical wires together. The side openings 606' and 608' provide means for facilitating mounting the bulb stands to the C-shaped portions 606 and 608 and also providing elastic deformation to more securely hold the bulb stand or the electrical wires therein.

Figure 9:
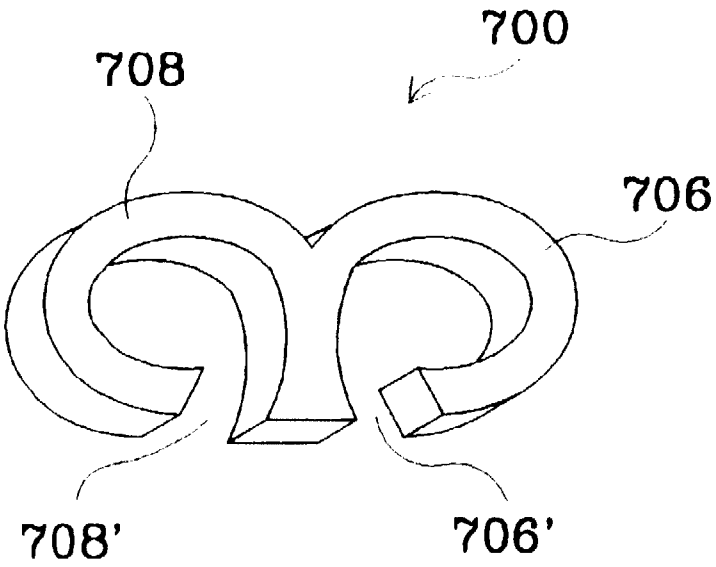
FIG. 9 is a perspective view showing a seventh embodiment of the present invention.

FIG. 9 shows a bulb stand clipping structure in accordance with a seventh embodiment of the present invention, which is designated with reference numeral 700, comprising a first portion 706 and a second portion 708, both being in the form of a C shape having a side opening 706' or 708' and connected in such a way for define an ω shape. The C-shaped portions 706 and 708 have a size sufficient to receive therein bulb stands (not shown) so as to fix two bulb stands together, or alternatively receiving a portion of electrical wires (not shown) therein so as to secure the electrical wires to a bulb stand or to secure two portions of the electrical wires together. The side openings 706' and 708' provide means for facilitating mounting the bulb stand to the C-shaped portions 706 and 708 and also providing elastic deformation to more securely hold the bulb stand or the electrical wires therein.

Figure 10:
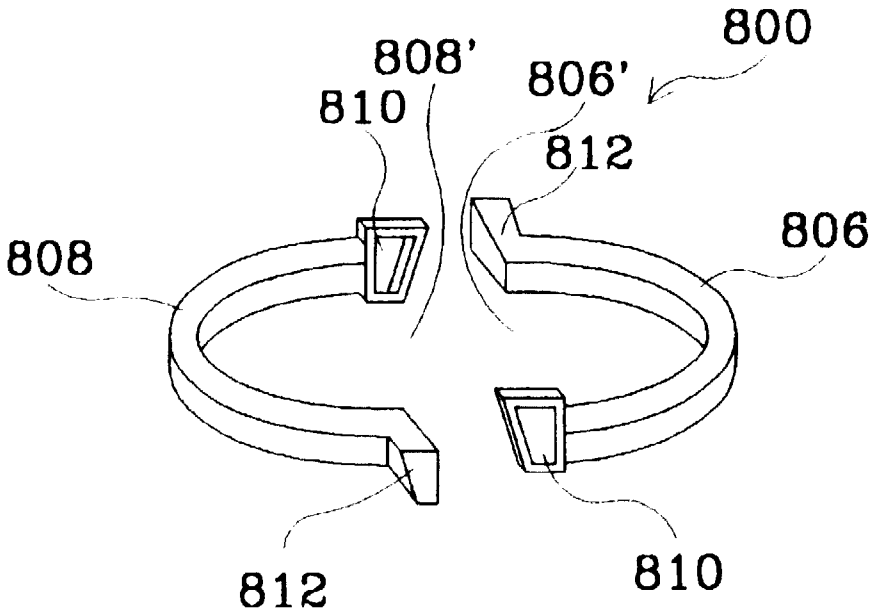
FIG. 10 is a perspective view showing an eighth embodiment of the present invention.

FIG. 10 shows a bulb stand clipping structure in accordance with an eighth embodiment of the present invention, which is designated with reference numeral 800, comprising a first portion 806 and a second portion 808, both being in the form of a C shape having a side opening 806' or 808'. The C-shaped portions 806 and 808 have a size sufficient to receive therein bulb stands (not shown), or alternatively receiving a portion of electrical wires (not shown) therein. The two C-shaped portions 806 and 808 are separated from each other and provided with fastener means for releasably securing to each other with the openings 806' and 808' coincident with each other so as to secure two bulb stands together or to secure the electrical wires to a bulb stand or to secure two portions of the electrical wires together. The side openings 806' and 808' provide means for facilitating mounting the bulb stand to the C-shaped portions 806 and 808 and also providing elastic deformation to more securely hold the bulb stand or the electrical wires therein.

The means for securing the first and second portions 806 and 808 of the eighth embodiment to each other comprises a slot 810 formed on one end of each of the C shapes 806 and 808 and a projection 812 on the opposite end of the C shape so as to be received and held within the slot 810 to secure the two C shapes 806 and 808 together.

It is apparent that although the present invention is illustrated with the description of the preferred embodiments thereof, it is contemplated that there may be changes and modifications in the described embodiments that can be carried out without departing from the scope of the invention which is intended to be limited only by the appended claims.

What is claimed is:

1. A clipping structure adapted to secure two light structures to each other, the light structures comprising bulb stands and electrical wires, the clipping structure comprising:

a first portion adapted to engage and hold a first one of the light structures and a second portion adapted to engage and hold a second one of the light structures, said first portion comprises a C-shaped member having a side opening defined by two ends of said first portion and said second portion comprises a C-shaped member having a side opening defined by two ends of said second portion, and wherein said first portion has an opening formed on a first one of said ends thereof and a projection formed on a second one of said ends thereof, and wherein said second portion has an opening formed on a first one of said ends thereof and a projection formed on a second one of said ends thereof so as to allow said second portion to be connected to said first portion by having said projection thereof inserted into said opening of said first portion and said projection of said first portion inserted into said opening of said second portion.

* * * * *